United States Patent [19]

Lampman

[11] Patent Number: 4,632,469

[45] Date of Patent: Dec. 30, 1986

[54] HOUSING FOR DISPLAYING ARTICLES

[76] Inventor: David V. Lampman, 439 Madison St., Wilkes-Barre, Pa. 18705

[21] Appl. No.: 668,902

[22] Filed: Nov. 7, 1984

[51] Int. Cl.[4] ..... A47F 3/00

[52] U.S. Cl. ..... 312/114; 248/318; 312/245; 312/247

[58] Field of Search ..... 312/114, 117, 247, 245; 229/41 C; 248/318, 317

[56] References Cited

U.S. PATENT DOCUMENTS

| | | | |
|---|---|---|---|
| 1,046,489 | 12/1912 | Pitcher | 248/317 |
| 1,741,008 | 12/1929 | Bourke et al. | 312/247 X |
| 2,544,034 | 3/1951 | Levering | 446/417 |
| 3,717,395 | 2/1973 | Spielvogel et al. | 312/117 |
| 3,721,484 | 3/1973 | Macioge et al. | 312/247 |
| 4,359,182 | 11/1982 | Perkins, Jr. | 229/41 C |
| 4,364,616 | 12/1982 | Harkins et al. | 312/223 |
| 4,374,560 | 2/1983 | Howlett | 229/41 C |
| 4,386,729 | 6/1983 | Schmidt | 229/41 C |
| 4,462,066 | 7/1984 | Gibson et al. | 446/447 X |

FOREIGN PATENT DOCUMENTS

| | | | |
|---|---|---|---|
| 2230213 | 5/1973 | Fed. Rep. of Germany | 312/114 R |

*Primary Examiner*—James T. McCall

*Attorney, Agent, or Firm*—Bacon & Thomas

[57] ABSTRACT

A housing for displaying articles comprised of sidewalls formed by a plurality of transparent panels disposed in a polygonal configuration and at least two frameworks forming the top and bottom of the housing to collectively define with the panels an interior compartment within which various articles may be placed and removed through at least one opening provided in the sidewalls. The housing also includes an adjustable support for disposing the housing at a desired vertical position, and internal lighting for illuminating the displayed articles and ambient area surrounding the housing.

9 Claims, 7 Drawing Figures

7
3
5
1
9
11
39
35
35
13
23
19
33
23
25
4
4
37
15
35
21
33
41
29
23
5
5
53
37
37
17

5
1
9
11
35
39
25
27
33
33
37
35
41
37
53
37

6
7
35
35
1
13
45
45
45
39
9
11
35
35
6
7

HOUSING FOR DISPLAYING ARTICLES

BACKGROUND OF THE INVENTION

1. Field of the Invention

The present invention generally relates to the field of technology pertaining to display cases. More specifically, the invention is directed to an improved structure for an illuminated housing used to display various articles.

2. Description of the Prior Art

It is well known to provide a case having a compartment therein for containing and displaying articles through at least one transparent wall of the compartment. Such cases may also have plural transparent walls through which the displayed articles may be viewed from several directions, with the viewing being further enhanced by illuminating the interior of the case with an appropriate lighting fixture. Conventional display cases may assume a variety of configurations and forms, depending primarily upon the specific application of use and the nature of the articles being displayed. For example, a case in the configuration of a house having one entire wall section removed for gaining access into individual rooms of the house is of course well known for the display of miniature dolls and furniture. Cases have also been constructed from transparent materials for the purpose of creating terrariums wherein plants and live animals may be displayed.

However, a distinct limitation of heretofore known display cases is the fact that because the configuration and structure of a given case is basically determined by the nature of the articles intended to be displayed, such cases therefore are only limited to a specific function and cannot be easily utilized for other purposes.

SUMMARY OF THE INVENTION

It is an object of the present invention to provide an improved display case that may be used to display a variety of different articles.

It is another object of the invention to provide an improved display case which is capable of performing a variety of different display functions.

It is a further object of the invention to provide an improved display case which affords an enhanced display of the articles contained therein for maximum display effect.

It is yet another object of the invention to provide an improved display case which illuminates both the articles being displayed therein and the ambient area surrounding the case.

It is still a further object of the invention to provide an improved display case which is simple in construction, economical to manufacture and affords maximum visual and manual access to the articles being displayed therein.

These and other objects of the invention are realized by providing a housing for displaying articles wherein the housing is essentially defined by a plurality of transparent panels that are disposed in a polygonal configuration, preferably octagonal, for forming the side walls of the housing. At least two frameworks, each in the form of an open grid, are provided for forming the top and bottom of the housing, wherein the panels and frameworks collectively define at least one interior compartment for containing and displaying articles. The sidewalls of the housing are preferably provided with plural access openings spaced around the perimeter thereof for facilitating the placement of articles within and the removal of articles from the compartment. The housing preferably includes a third framework, also in the form of an open grid, disposed between and spaced from the frameworks forming the top and bottom of the housing to define therewith a pair of interior compartments that are particularly useful in permitting the housing to be utilized as a doll house for displaying miniature dolls and furniture. In this latter respect, the housing may also include simulated and miniaturized housing fixtures, including a fireplace, a cabinet assembly and the like. The housing is also provided with support means whereby the housing may be variably disposed at a desired vertical position, preferably through suspending the housing by an adjustable length of chain secured to an overhead support. A lighting fixture is provided for illuminating the articles displayed in the interior compartment and also the exterior ambient area surrounding the housing. A music box may also be associated with the housing in order to provide audio entertainment for accompanying the visual display.

Other objects, features and advantages of the invention shall become apparent from the following description and appended claims, reference being made to the accompanying drawings forming a part of the specification, wherein like reference characters designate corresponding parts of the several views.

DETAILED DESCRIPTION OF THE PREFERRED EMBODIMENT

Figure 1:
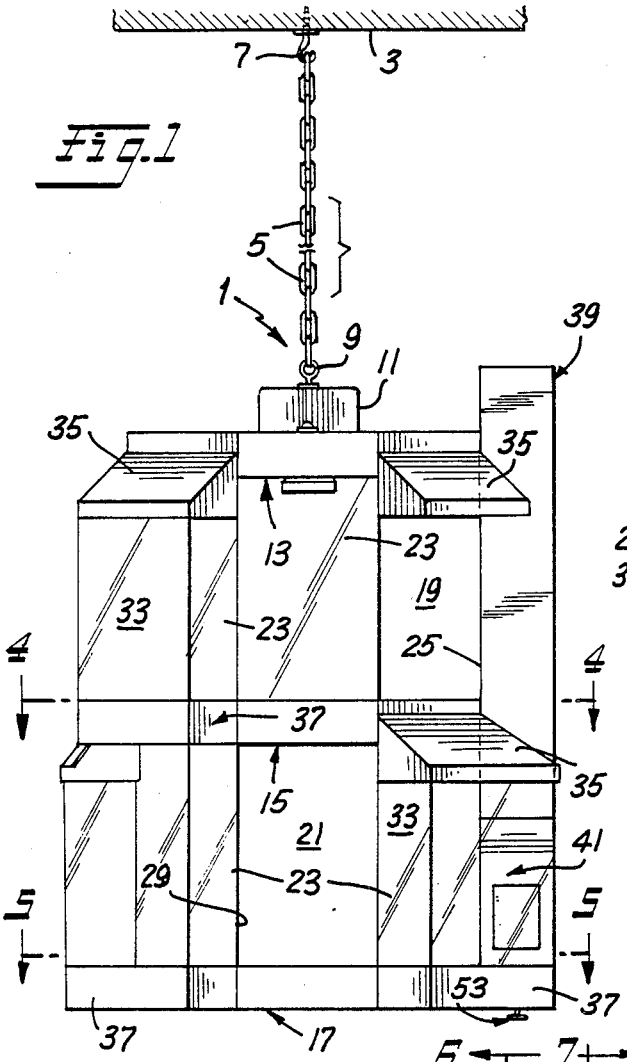
FIG. 1 is a front elevational view of a housing for displaying articles in accordance with a preferred embodiment of the invention.

A housing 1 for displaying articles in accordance with a preferred embodiment of the invention shall now be described with initial reference to FIGS. 1 and 2. As shown therein, housing 1 is preferably suspended from an overhead support 3 by means of a chain 5 or other such appliance which is adjustable and permits the vertical position of housing 1 to be varied. Chain 5 may have one end attached to overhead support 3 by means of a hook 7, and its other end attached to housing 1 through an eyelet 9 carried by a junction box 11 secured to the top of housing 1. Alternatively, housing 1 may be supported on top of a vertical post (not shown) or similar device that is also preferably adjustable to permit varying the vertical position of housing 1.

Housing 1 includes an upper primary framework 13, an intermediate primary framework 15 and a lower primary framework 17 spaced from each other. Frameworks 13 and 15 define, respectively, the top and bottom portions of an upper compartment 19. Similarly, frameworks 15 and 17 define, respectively, the top and bottom portions of a lower compartment 21. The sidewalls of compartments 19 and 21 are formed from a plurality of panels 23 of varying sizes and carried around the peripheries of frameworks 13, 15 and 17. Panels 23 are preferably formed of transparent material in order to permit substantially complete visual access to the interiors of compartments 19 and 21 from all sides of housing 1. Physical access to the interior of compartment 19 is made possible by omitting two panels 23 so as to form a pair of openings 25 and 27. Similarly, access into compartment 21 may also be gained by omitting two panels 23 so as to define a pair of openings 29 and 31, with opening 31 being more apparent in FIG. 5. However, it is to be understood that the number of panels omitted and the consequent number of openings provided may of course be varied as desired, as well as the actual positioning of the openings around the periphery of housing 1.

Figure 2:
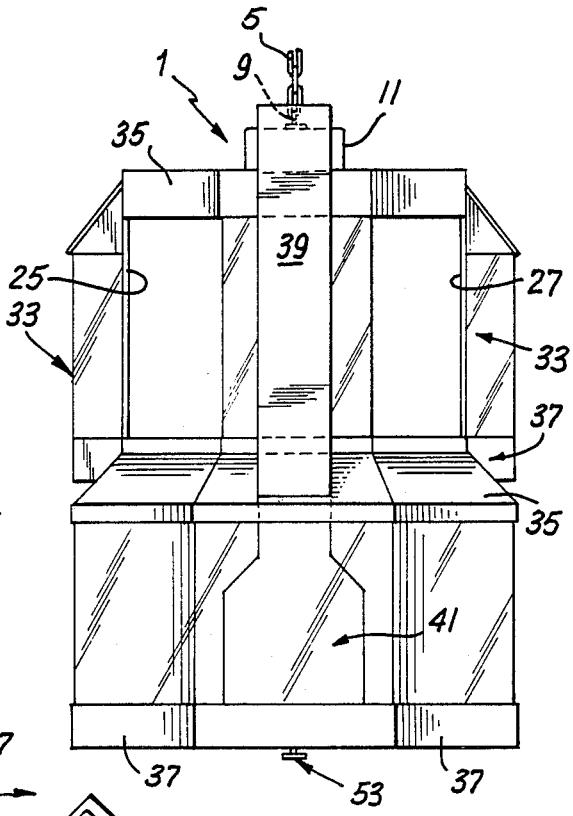
FIG. 2 is a right side elevational view of the housing shown in FIG. 1.

As further evident in FIGS. 1 and 2, panels 23 may be of different widths in order to form a plurality of outwardly extending bay sections 33, with each section 33 being also provided with a corresponding roof 35 and a secondary framework 37. It is also understood that a plurality of roofs 35 may be provided at those locations where there is no bay section 33, such as an opening 25 and 27.

A simulated chimney structure, indicated generally at 39, may be provided to bridge compartments 19 and 21, and also define portions of the sidewalls of same. Chimney structure 39 is particularly desirable when housing 1 is utilized as a doll house, with an appropriate simulation of a fireplace 41 also provided within compartment 21, with fireplace 41 being more clearly shown in FIG. 7. In addition to chimney 39 and fireplace 41, it is understood that other structures simulating fixtures of a conventional house may also be incorporated within housing 1, depending upon the intended use of housing 1. For example, as shown in FIG. 6, a wall cabinet assembly 43 may also be provided.

Figure 3:
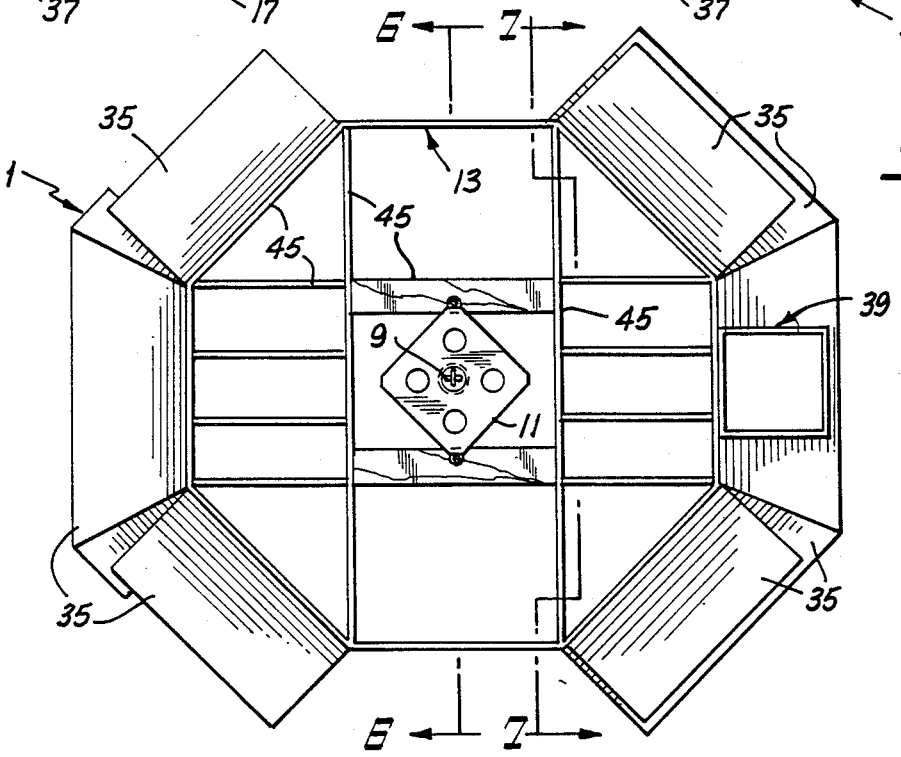
FIG. 3 is a top plan view, on a larger scale, of the housing shown in FIG. 1.
Figure 4:
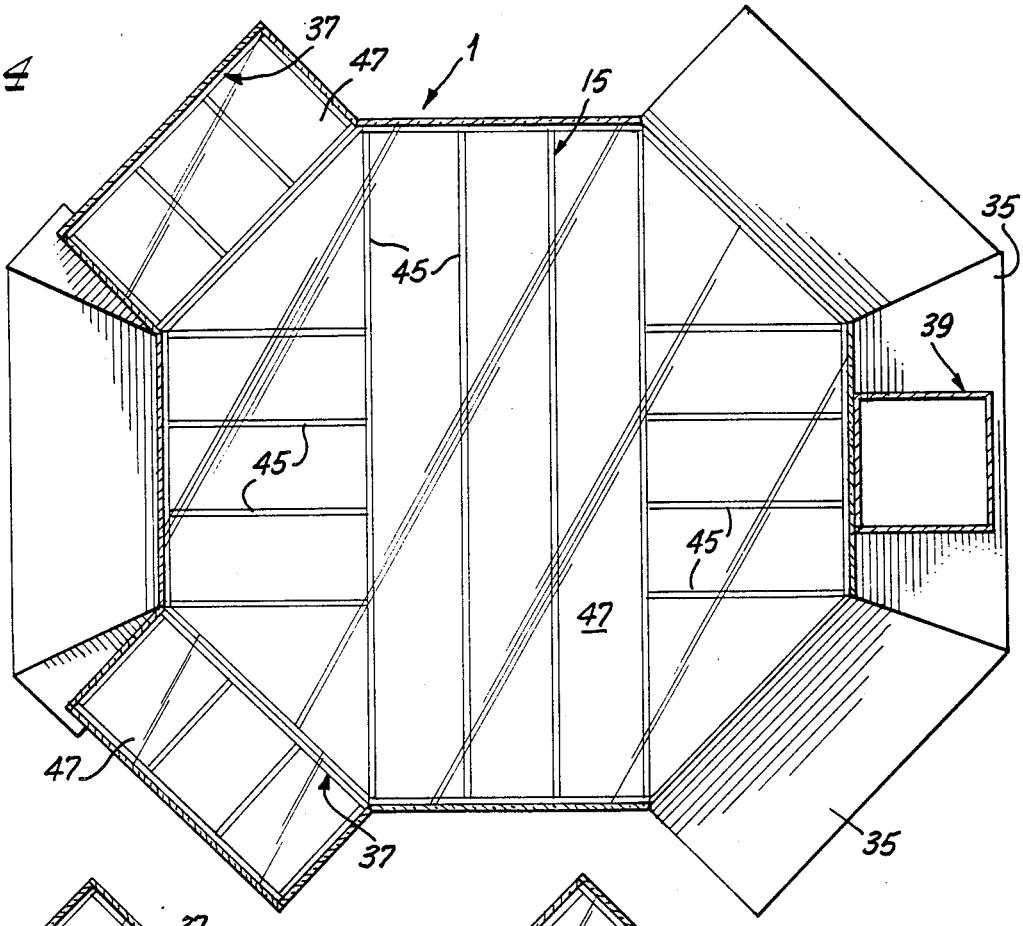
FIG. 4 is an enlarged horizontal sectional view, taken on the line 4—4 of FIG. 1.
Figure 5:
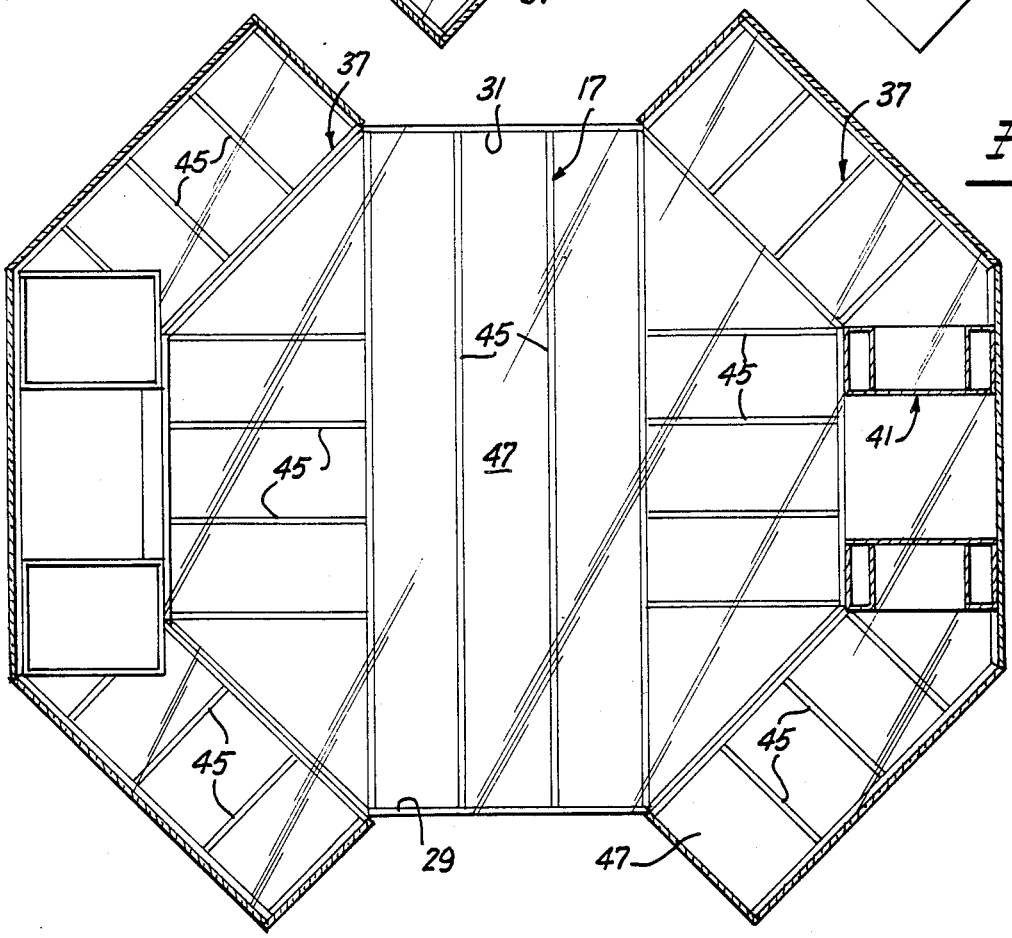
FIG. 5 is a horizontal sectional view, taken on the line 5—5 of FIG. 1.

Referring more particularly to FIGS. 3, 4 and 5, wherein housing 1 is depicted in three descending levels of transverse view, it is immediately apparent that the overall transverse configuration of housing 1 is of substantially octagonal configuration. Primary frameworks 13, 15 and 17 are preferably of the same size and configuration, with each such framework being formed from a plurality of rigid members 45 secured together in a spaced manner to define an open grid. Similarly, each secondary framework 37 may also be formed in a similar manner. The configurations of the grids forming frameworks 13, 15, 17 and 37 may vary and preferably comprise those affording aesthetic geometrical shapes and structural strength. Because of the open grid configurations forming frameworks 13, 15, 17 and 37, light is permitted to transmit through housing 1, thereby further enhancing visual access to the articles being displayed therein. As shown in FIGS. 4 and 5, frameworks 15, 17 and 37 are each provided with an overlying sheet 47 of transparent material having the corresponding size and shape of its associated framework. The purpose of sheets 47 is to permit support of articles on their associated frameworks since the latter are of open grid construction.

Figure 6:
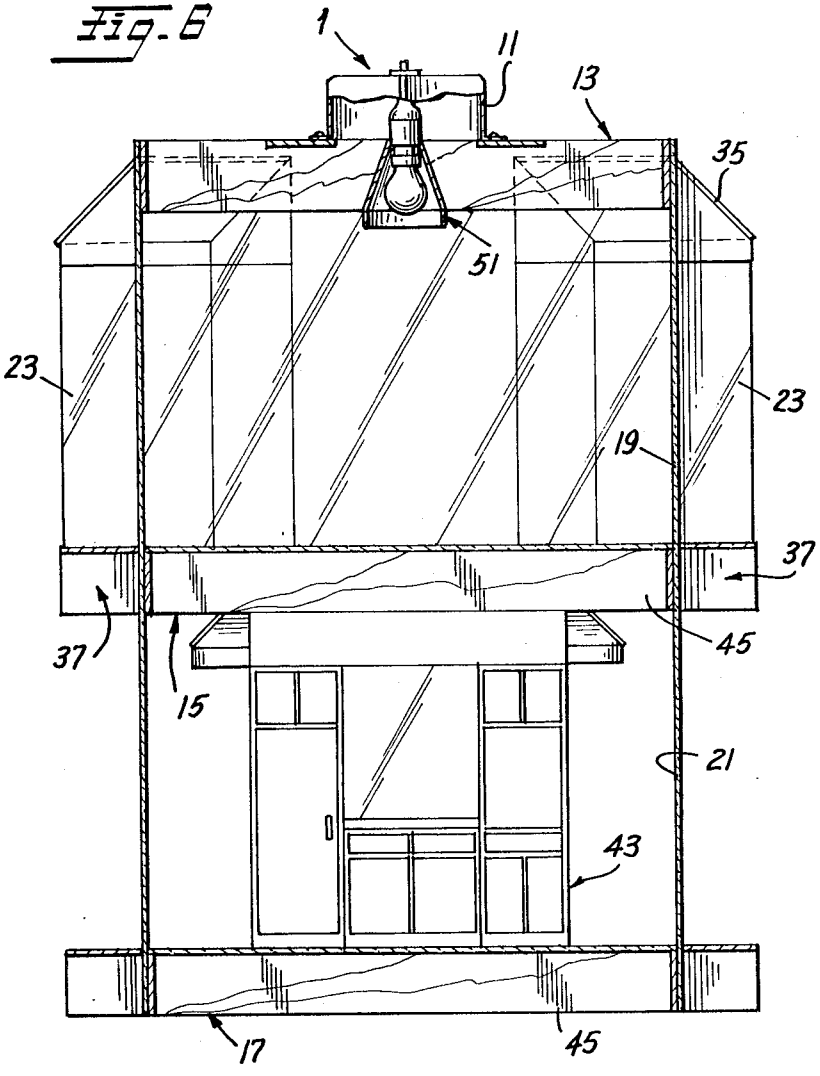
FIG. 6 is a vertical sectional view, on a smaller scale, taken on the line 6—6 of FIG. 3.

As more clearly shown in FIG. 6, junction box 11 may be provided with a conventional electric light fixture 51 for the purpose of illuminating the interiors of compartments 19 and 21. Though fixture 51 is shown as disposed in compartment 19, illumination of compartment 21 is substantially realized by virtue of the open grid construction of framework 15 and its associated overlying transparent panel 47. Likewise, since framework 17 of compartment 21 shares the same construction, illumination is also realized in the area directly below housing 1. Moreover, because the sidewalls of housing 1 are formed from transparent panels 23, illumination is also realized in the entire ambient area surrounding housing 1 so that, in effect, housing 1 not only functions as a means for displaying articles, but also serves in the capacity of a hanging lamp. This dual function is extremely advantageous in enhancing the display of articles placed within compartments 19 and 21, and affords virtually complete visual access thereto.

Figure 7:
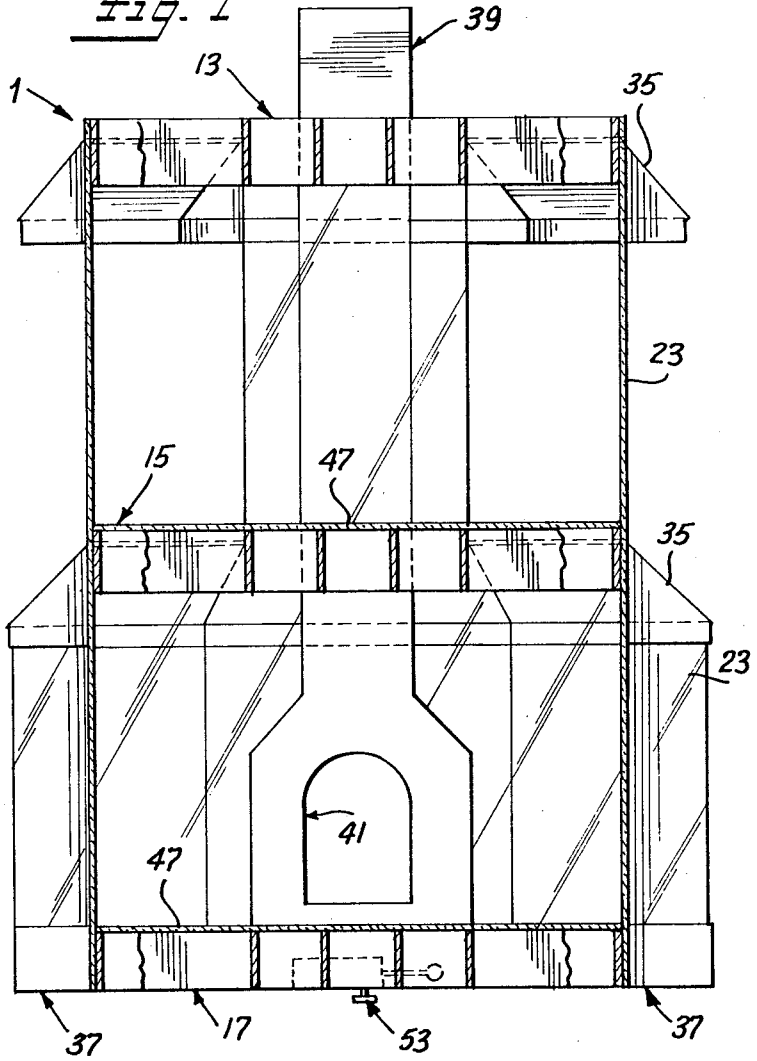
FIG. 7 is a vertical sectional view, taken on the line 7—7 of FIG. 3.

With reference to FIG. 7, there is also shown the provision of a music box, indicated generally at 53. Music box 53 may be supported within the open grid construction of framework 17 or at any other suitable location on or within housing 1. The purpose of music box 53 is to provide an extra dimension of audio enjoyment to the visual effects created by the articles displayed within housing 1.

By virtue of the aforedescribed construction of housing 1, it is apparent that housing 1 may be utilized to advantage for many different purposes. For example, miniature collectibles of high detail may be clearly shown by virtue of the illumination provided by fixture 51 and the visually transparent sidewalls, tops and bottoms of housing 1. Also, housing 1 can function as a terrarium for containing plants which are able to receive maximum ambient lighting in addition to lighting provided by fixture 51, in which case fixture 51 may include a conventional bulb designed for enhancing plant growth. Housing 1 may also be advantageously utilized as a doll house for young children since the vertical position of housing 1 may be easily changed by varying the length of chain 5. In this latter application, simulated chimney 39, fireplace 41 and wall cabinet assembly 43 all serve to provide a miniaturized but realistic version of a house, with easy access being gained to compartments 19 and 21 through openings 25, 27, 29 and 31 for the placement and removal of dolls and furniture articles.

Panels 23 and panels 47 may be formed from any appropriate sheet of transparent material deemed suitable for the practice of the invention as disclosed herein, including plastic, glass or the like. Roofs 35 may be formed of plastic, metal or any other such suitable material. While it is preferred that rigid members 45 forming frameworks 13, 15, 17 and 37 be preferably of wood to simulate realistic house construction, they may also be of plastic, metal or other rigid material. The individual parts forming housing 1 may be glued or secured together with any appropriate fastening means.

It is to be understood that the embodiment of the invention herein shown and described is to be taken as merely a preferred example of the same, and that various changes in the shapes, sizes, arrangement of parts, compositions and methods of use and operation may be resorted to, without departing from the spirit of the invention or scope of the subjoined claims.

I claim:

1. An improved housing for displaying articles comprising:

(a) a plurality of transparent panels disposed in a polygonal configuration for forming the sidewalls of the housing;

(b) a first primary framework forming the top of the housing;

(c) a second primary framework forming the bottom of the housing;

(d) at least one bay section extending outwardly from the peripheries of the first and second primary frameworks, the bay section being defined by a roof, a plurality of transparent panels and a second framework;

(e) the sidewalls and primary frameworks collectively defining an interior compartment;

(f) at least one opening in the sidewalls for permitting the placement of articles within and the removal of articles from the interior compartment; and (g) means for supporting the housing at a desired vertical position.

2. The improved housing of claim 1 further including means for illuminating the interior compartment.

3. The improved housing of claim 1 wherein the polygonal configuration is substantially octagonal.

4. The improved housing of claim 1 further including a third primary framework disposed between and spaced from the first and second primary frameworks for defining two interior compartments therewith.

5. The improved housing of claim 4 wherein each of the primary frameworks is formed from a plurality of spaced rigid members disposed in an open grid configuration.

6. The improved housing of claim 5 wherein the second and third primary frameworks each includes an overlying transparent panel defining a support surface for articles.

7. The improved housing of claim 1 wherein the means for supporting the housing includes a length of chain for suspending the housing from an overhead support.

8. The improved housing of claim 1 wherein the first and second primary frameworks are each of an octagonal configuration.

9. The improved housing of claim 1 wherein the at least one opening extends between two corresponding sides of the first and second primary frameworks.

* * * * *